US007477010B2

(12) United States Patent
Seo

(10) Patent No.: US 7,477,010 B2
(45) Date of Patent: Jan. 13, 2009

(54) ELECTRON EMISSION APPARATUS HAVING SUPPORTING MEMBER

(75) Inventor: Hyoung Cheol Seo, Daejeon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 606 days.

(21) Appl. No.: 11/173,185

(22) Filed: Jun. 30, 2005

(65) Prior Publication Data

US 2006/0038482 A1 Feb. 23, 2006

(30) Foreign Application Priority Data

Jun. 30, 2004 (KR) ..... 10-2004-0050635

(51) Int. Cl.
*H01J 1/62* (2006.01)

(52) U.S. Cl. ..... 313/495

(58) Field of Classification Search ..... 313/495, 313/252, 292

See application file for complete search history.

(56) References Cited

U.S. PATENT DOCUMENTS

2006/0001359 A1* 1/2006 Hwang ..... 313/495

2006/0220524 A1* 10/2006 Jeon et al. ..... 313/495

* cited by examiner

*Primary Examiner*—Vip Patel
(74) *Attorney, Agent, or Firm*—Christie, Parker & Hale, LLP

(57) ABSTRACT

An electron emission apparatus includes a first plate sectioned according to sub-pixels and including an electron emission part, and a second plate opposite to the first plate and including a plurality of light emission regions in which electrons emitted by the electron emission part collide with a fluorescent material and a plurality of non-light emission regions. The electron emission apparatus also includes a supporting member extending in at least one direction and supporting the first and second plates. End portions of the supporting member are disposed at intersections between the non-light emission regions that extend in substantially perpendicular directions with respect to each other, at least one of the non-light emission regions having a predetermined width along the at least one extending direction of the supporting member. With this configuration, an electron emission apparatus in which an electron beam is substantially prevented from deflecting and arcing due to a charged supporting member can be provided.

17 Claims, 8 Drawing Sheets

ELECTRON EMISSION APPARATUS HAVING SUPPORTING MEMBER

CROSS-REFERENCE TO RELATED APPLICATIONS

This application claims priority to and the benefit of Korean Patent Application No. 10-2004-0050635, filed on Jun. 30, 2004, in the Korean Intellectual Property Office, the entire disclosure of which is incorporated herein by reference.

BACKGROUND

1. Field of the Invention

The present invention relates to an electron emission apparatus provided with an electron beam source plate and a light emitting plate placed face to face.

2. Discussion of Related Art

Generally, an electron emission device is classified as a hot or cold cathode type, wherein the hot cathode type and the cold cathode type respectively employ a hot cathode and a cold cathode as an electron emission source. A cold cathode type electron emission device includes a structure such as a field emitter array (FEA), a surface conduction emitter (SCE), a metal insulating layer metal (MIM), a metal insulating layer semiconductor (MIS), and a ballistic electron surface emitter (BSE).

The electron emission device having the FEA structure is based on a principle that a material having a low work function and a high β-function easily emits electrons in a vacuum in response to an electric field difference, thereby operating as an electron emission source. Such an electron emission device having the FEA structure has been developed, which uses a tip structure, a carbon material, or a nano material as the electron emission source.

The electron emission device having the SCE structure includes an electron emission part, which has a conductive layer placed on a plate between two electrodes opposite each other and formed with a minute crack or gap, thereby forming the electron emission part. Such an electron emission device is based on a principle that the electron emission part formed by a minute crack or gap emits electrons when electric current due to a voltage applied between two electrodes flows through the surface of the conductive layer.

The electron emission device having an MIM or MIS structure includes an electron emission source having a metal-insulator-metal structure or a metal-insulator-semiconductor structure, and is based on a principle that electrons are moved and accelerated from a metal or semiconductor of high electric potential to a metal of low electric potential when a voltage is applied between the metal and the metal or between the metal and the semiconductor, respectively, thereby emitting electrons.

The electron emission device having the BSE structure is based on a principle that electrons travel without sputtering when the size of a semiconductor is smaller than a mean free path of the electrons contained in the semiconductor. Such an electron emission device includes an electron supplying layer made of a metal or a semiconductor and formed on an ohmic electrode, an insulator formed on the electron supplying layer, and a thin metal layer formed on the insulator, so that electrons are emitted when a voltage is applied between the ohmic electrode and the thin metal layer.

The above-referenced electron emission devices are employed in an electron emission apparatus, various backlights, and a lithography electron beam, etc. The electron emission apparatus includes an electron emission part provided with the electron emission device to emit electrons, and a light emission region in which the emitted electrons collide with a fluorescent material to emit light. Generally, the electron emission apparatus includes a plurality of electron emission devices formed on a first plate; and a fluorescent layer formed on a second plate and colliding with the electrons emitted from the first plate.

Further, in the electron emission apparatus, a supporting member is provided between the first plate and the second plate.

However, in the conventional electron emission apparatus, some electrons emitted from the electron emission part may collide not with a corresponding sub-pixel but with other sub-pixel, or may not collide with the fluorescent layer but with a surface of the supporting member and be thus charged in the supporting member. The charged supporting member deflects the electrons emitted from the electron emission part and traveling toward the fluorescent layer. Further, when the supporting member is charged by a predetermined quantity of electric charge or more, the electric charge may bolt out of the supporting member, thereby generating an arc.

SUMMARY OF THE INVENTION

Accordingly, it is an aspect of the present invention to provide an electron emission apparatus having an improved structure in which electrons emitted from an electron emission part are substantially prevented from colliding with and causing charges to accumulate at an end or side portion of a supporting member.

Another aspect of the present invention is to provide an electron emission apparatus, which improves or optimizes disposition or location of a supporting member relative to a light emission region with which the electrons emitted from the electron emission part may collide.

The forgoing and/or other aspects of the present invention are achieved by providing an electron emission apparatus including a first plate sectioned according to sub-pixels and including an electron emission part, and a second plate opposite to the first plate and including a plurality of light emission regions in which electrons emitted by the electron emission part collide with a fluorescent material and a plurality of non-light emission regions. The electron emission apparatus also includes a supporting member extending in at least one direction and supporting the first and second plates. End portions of the supporting member are disposed at intersections between the non-light emission regions that extend in substantially perpendicular directions with respect to each other, and at least one of the non-light emission regions has a predetermined width along the at least one extending direction of the supporting member.

According to an aspect of the present invention, at least one portion of the non-light emission regions may be provided with an optical shielding film.

According to an aspect of the present invention, the supporting member may have either a cross shape or a straight shape, each of the light emission regions may have a rectangular shape, and the fluorescent material may be provided in each of the light emission regions.

Another aspect of the present invention is achieved by providing an electron emission apparatus including a first plate sectioned according to sub-pixels and including an electron emission part, and a second plate opposite to the first plate and including a plurality of light emission regions in which electrons emitted according to the sub-pixels formed in a predetermined shape collide and a plurality of non-light emission regions formed between the sub-pixels. The electron emission apparatus also includes a supporting member extending in at least one direction and supporting the first and second plates. End portions of the supporting member are disposed at intersections between the non-light emission regions that extend in substantially perpendicular directions with respect to each other, at least one of the non-light emission regions having a predetermined width along the at least one extending direction of the supporting member.

Yet another aspect of the present invention is achieved by providing an electron emission apparatus including a first plate including a plurality of electron emission parts that correspond to sub-pixels, and a second plate including a plurality of light emission regions and a plurality of non-light emission regions, wherein the light emission regions correspond to the sub-pixels. The electron emission apparatus also includes a supporting member extending in at least one direction and supporting the first and second plates. End portions of the supporting member are disposed so as to substantially prevent deflection of electron beams between the electron emission parts and the light emission regions.

Yet another aspect of the present invention is achieved by providing an electron emission apparatus including a first plate including a plurality of electron emission parts that correspond to sub-pixels, and a second plate including a plurality of light emission regions and a plurality of non-light emission regions. The light emission regions correspond to the sub-pixels and have a plurality of sides. The electron emission apparatus also includes a supporting member extending in at least one direction and supporting the first and second plates. End portions of the supporting member are located at non-light emission regions that are not adjacent to the sides of the light emission regions.

BRIEF DESCRIPTION OF THE DRAWINGS

These and/or other aspects and features of the present invention will become apparent and more readily appreciated from the following description of certain exemplary embodiments, taken in conjunction with the accompanying drawings of which.

DETAILED DESCRIPTION

Hereinafter, certain exemplary embodiments according to the present invention will be described in detail with reference to the accompanying drawings, wherein the exemplary embodiments of the present invention are disclosed to be readily understood by those skilled in the art. Those skilled in the art would recognize that various other modifications can be made to the described embodiments, and that the present invention is not limited to the following embodiments disclosed herein.

Figure 1A:
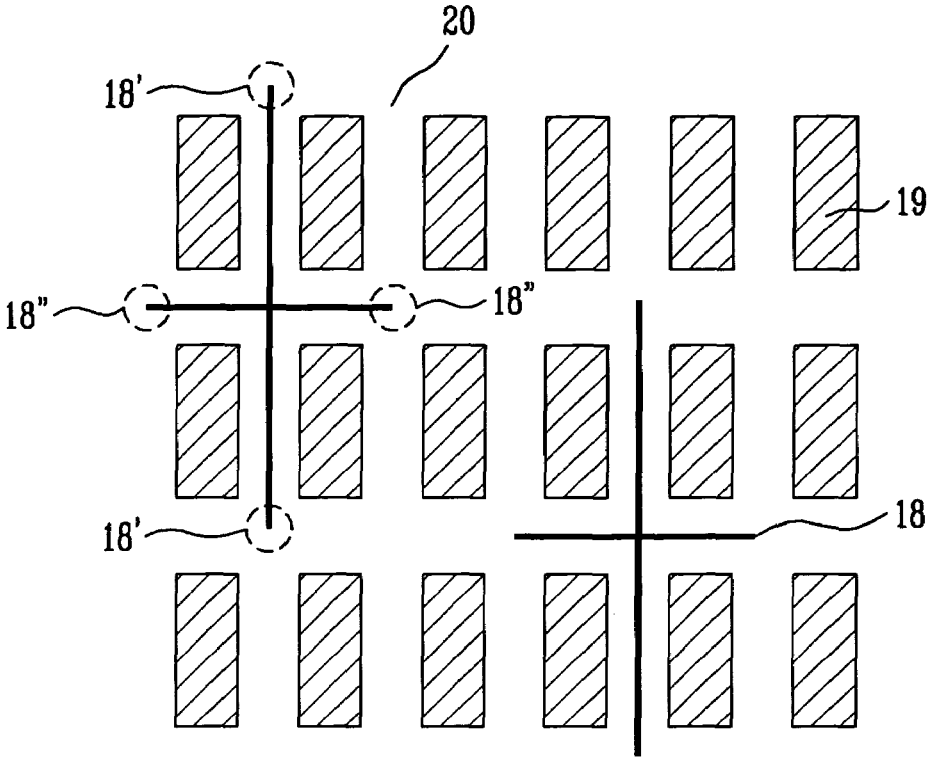
FIGS. 1A through 1C are schematic plan views illustrating the locations of end portions of supporting members in an electron emission apparatus according to exemplary embodiments of the present invention.
Figure 1B:
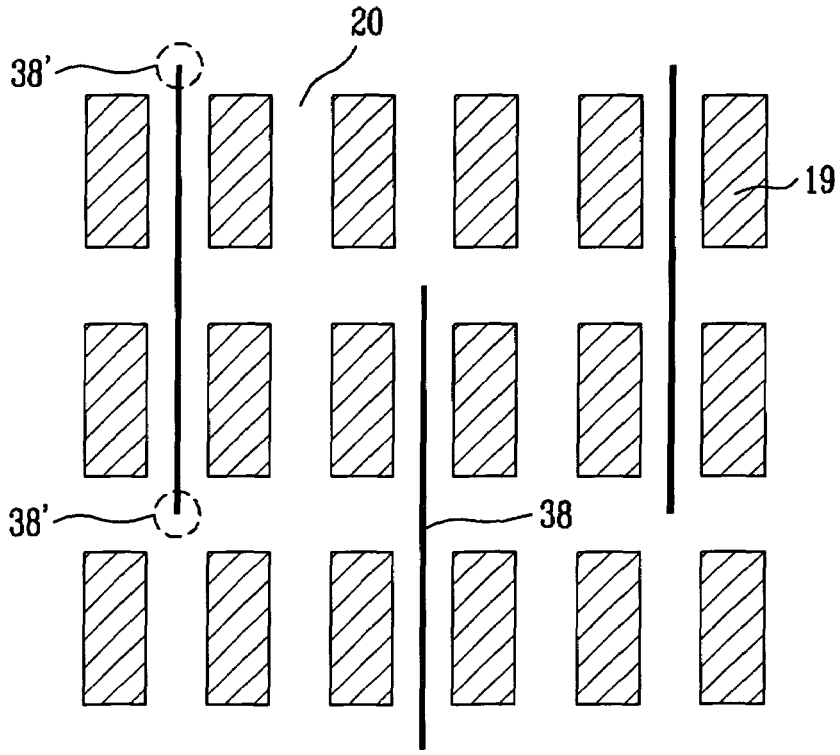
Figure 1C:
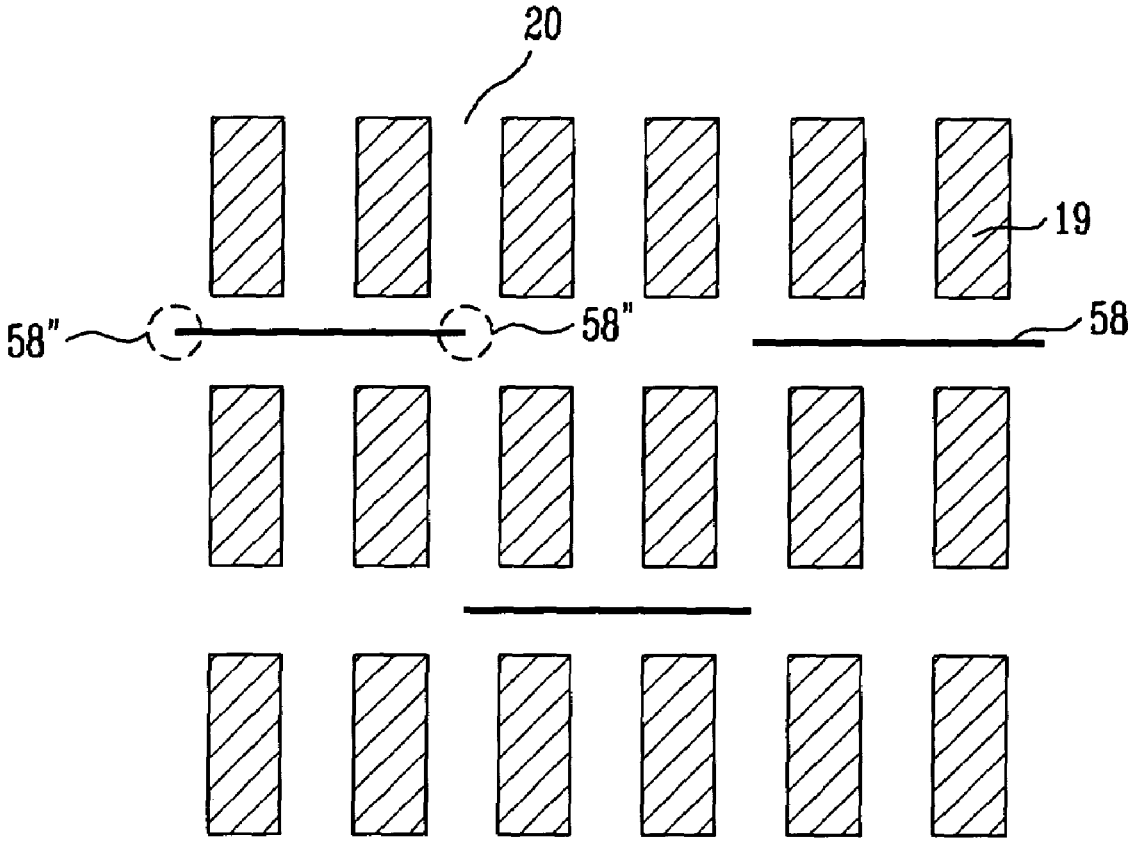

FIGS. 1A through 1C are schematic plan views that illustrate the locations of end portions of supporting members in an electron emission apparatus according to an exemplary embodiment of the present invention. In FIGS. 1A to 1C, the relative positions between the supporting members and light emission regions are illustrated.

The electron emission apparatus includes a first plate provided with electron emission parts sectioned according to -sub-pixels and emitting electrons; a second plate opposite to the first plate and sectioned into light emission regions and non-light emission regions; and a supporting member provided to support the first and second plates and extending in at least one direction, which is substantially parallel to the first and second plates. The light emission regions are defined by regions in which the electrons emitted according to the sub-pixels collide with a fluorescent material.

Referring to FIG. 1A, opposite end portions 18' of a supporting member 18 having a cross shape are disposed at intersections between non-light emission regions 20 that extend in substantially perpendicular directions with respect to each other, and respectively having a predetermined width along extending directions of the cross-shaped supporting member. The cross-shaped supporting member includes two bar-type sub-supporting members; one bar-type sub-supporting member and an element supporting the same; a supporting member having a cross shape; etc.

Light emission regions 19 refer to regions on which the electrons emitted from the electron emission part according to the sub-pixels collide, thereby emitting light. In contrast to the light emission regions 19, the non-light emission regions 20 substantially refer to regions on which the electrons do not frequently collide. For example, in an electron emission apparatus including an optical shielding film having a stripe or a matrix shape, the light emission regions 19 include red (R), green (G) and blue (B) fluorescent materials (e.g., in a stripe or a matrix shape), and the non-light emission regions 20 include the optical shielding region divided in a stripe or a matrix shape.

The supporting member 18 is disposed as described above and substantially prevents the electrons emitted from the electron emission part from causing charges to accumulate at the end portions 18', 18" thereof, so that the electron beam traveling toward the light emission region 19 is substantially prevented from being deflected. Also, an arc due to the electric charge charged in the supporting member is substantially prevented. FIGS. 1B and 1C are plan views illustrating relative positions between end portions of a supporting member having a straight shape and the light emission regions. Referring to FIGS. 1B and 1C, opposite end portions 38', 58", respectively, of the supporting members 38 and 58 having a straight shape are disposed at intersections between the non-light emission regions 20 that extend in substantially perpendicular directions with respect to each other, at least one of the non-light emission regions having a predetermined width along an extending direction of the straight or stripe-shaped supporting member.

The supporting member 18 of FIG. 1A, the supporting member 38 of FIG. 1B or the supporting member 58 of FIG. 1C is charged with positive electric charges due to the collision of the electrons emitted from the electron emission part, but is not limited to, and may be charged with negative electric charges depending on materials of the supporting members 18, 38 and 58. The supporting member 18, 38 or 58 charged with the positive electric charges attracts the electrons and deflects the electron beam. At this time, if the end portion 18', 18", 38' or 58" of the supporting member 18, 38 or 58 is near a trajectory of the electron beam, the electron beam passing near the end portion 18', 18", 38' or 58" is especially deflected. Therefore, the end portion 18', 18", 38' or 58" of the supporting member 18, 38 or 58 should be disposed or located away from the light emission regions so as not to be adjacent to the edges (i.e., sides) of the light emission regions.

Figure 2:
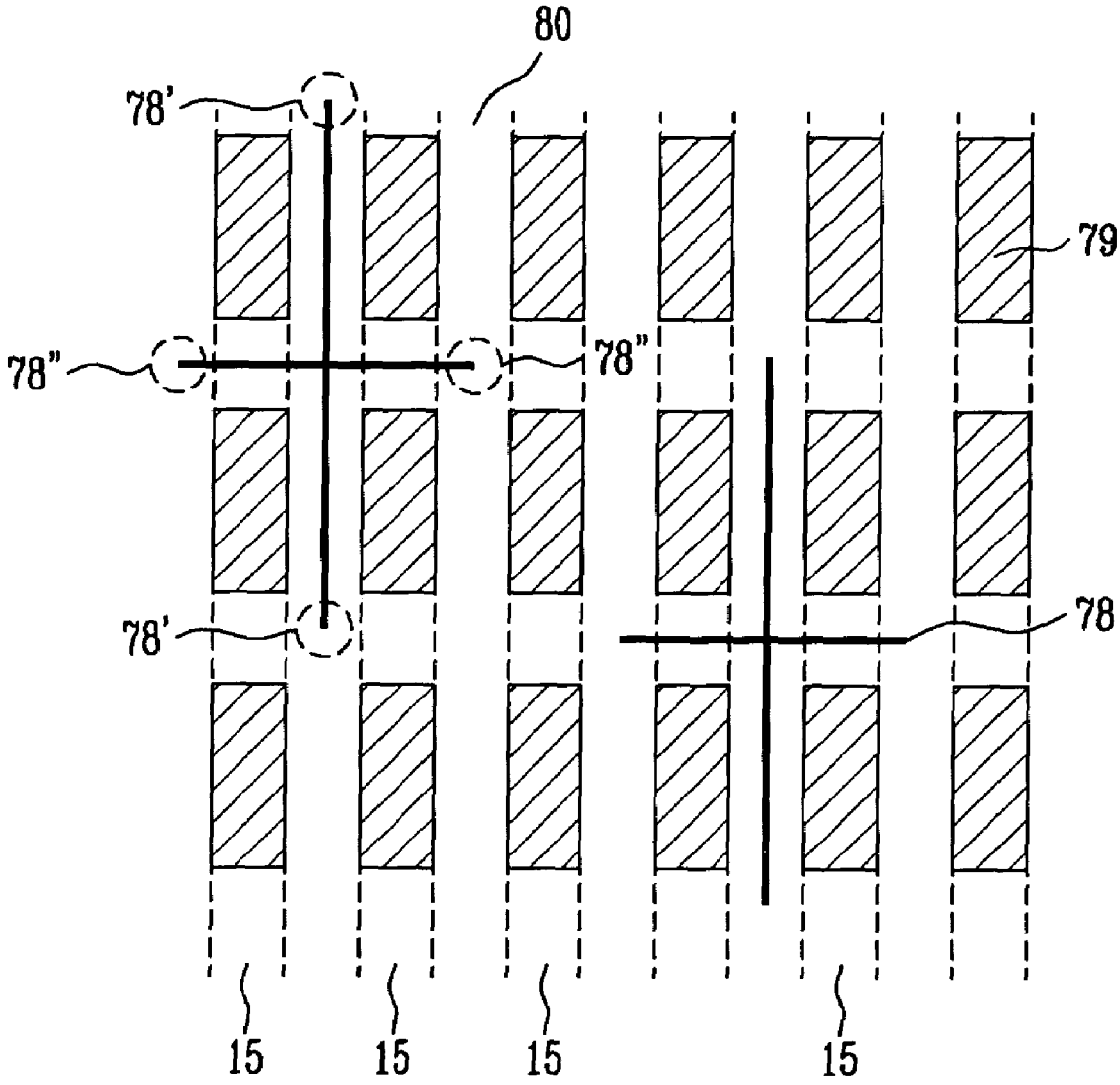
FIG. 2 is a schematic plan view illustrating a fluorescent layer having a stripe shape according to an exemplary embodiment of the present invention.

FIG. 2 is a schematic plan view that illustrates a fluorescent layer having a stripe shape according to an exemplary embodiment of the present invention. In FIG. 2, end portions 78' and 78" of the cross shaped supporting members 78 are formed in non-light emission regions 80 at intersections between the non-light emission regions that extend in substantially perpendicular directions with respect to each other. Referring to FIG. 2, a fluorescent material 15 has a stripe shape, and light emission regions are defined by a portion of the fluorescent material 15 having the stripe shape. Further, regions other than the fluorescent material 15 may include an optical shielding film.

Figure 3:
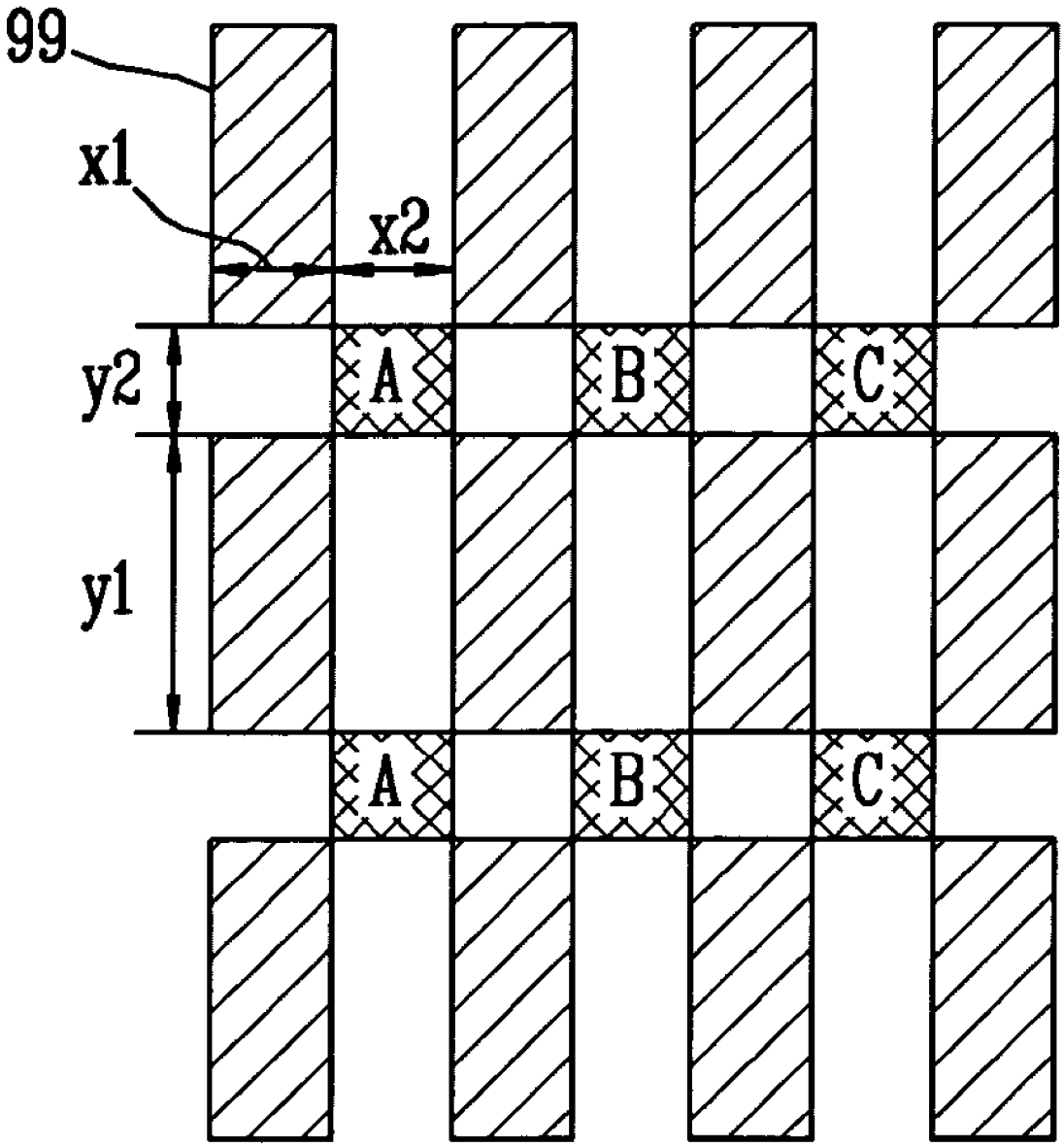
FIG. 3 is a plan view illustrating an end position of a supporting member in an electron emission apparatus according to an exemplary embodiment of the present invention.

FIG. 3 is a plan view that illustrates an end position of a supporting member in an electron emission apparatus according to an exemplary embodiment of the present invention.

Suppose each light emission region 99 has a rectangular shape having a width of $X_1$ and a length of $Y_1$, and each intersection between non-light emission regions that extend in substantially perpendicular directions with respect to each other has a width of $X_2$ and a length of $Y_2$ as shown in FIG. 3, and the supporting member has a length of L. The length L of the supporting member is defined by the following equations.

<Equations>

$n(X_1+X_2)-X_2 \leqq L \leqq n(X_1+X_2)+X_2$, (where, n is a natural number)

$m(Y_1+Y_2)-Y_2 \leqq L \leqq m(Y_1+Y_2)+Y_2$, (where, m is a natural number)

Referring to the equations, the end portions of the supporting members can be disposed at regions of A, B, and C shown in FIG. 3. In other words, the end portions of the supporting members can be disposed or located at intersections between the non-light emission regions that extend in substantially perpendicular directions with respect to each other. The non-light emission regions may have the width of X2 or Y2 depending on the direction in which they extend.

Figure 4A:
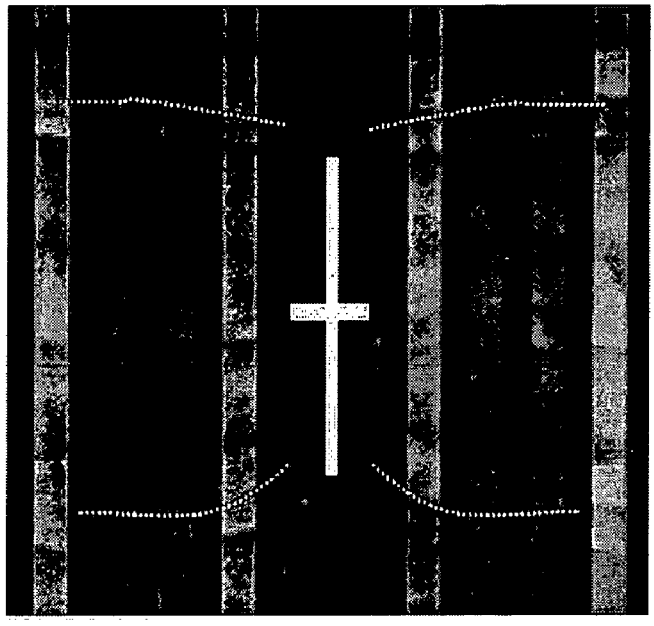
FIGS. 4A and 4B are photographs showing traces of an electron beam depending on whether a supporting member is provided or not.
Figure 4B:
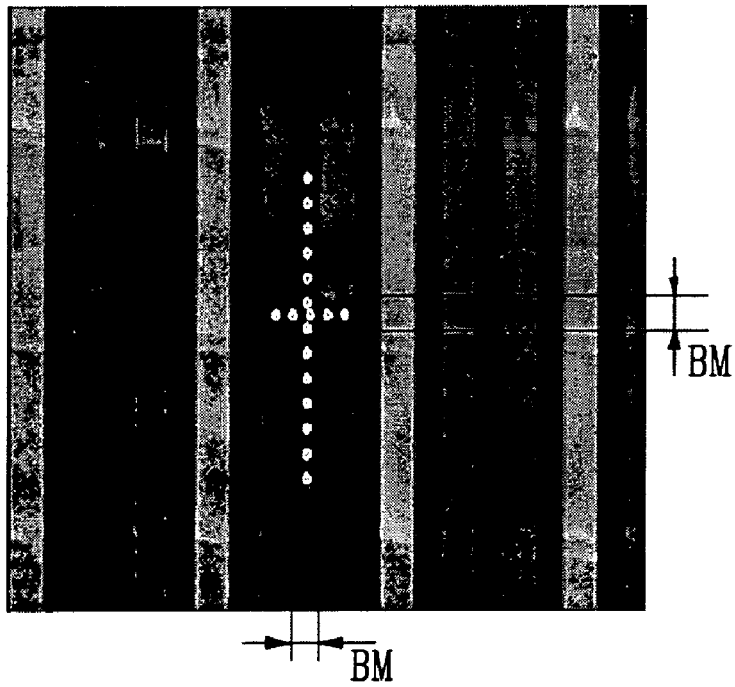

FIGS. 4A and 4B are photographs showing traces of the electron beam depending on whether the supporting member is provided or not. For reference, "BM" of FIG. 4B indicates a black matrix. FIG. 4A illustrates that the electron beam is deflected when the supporting member is provided, wherein the dotted lines indicate the deflected trajectories of the electron beams. In contrast, FIG. 4B illustrates that the electron beam normally travels to the light emission region when the supporting member is not provided. For the purpose of comparison, FIG. 4B illustrates an imaginary supporting member with dotted lines. By comparing FIG. 4A with FIG. 4B, it can be seen that the electron beam is deflected when the supporting member is provided.

Figure 5A:
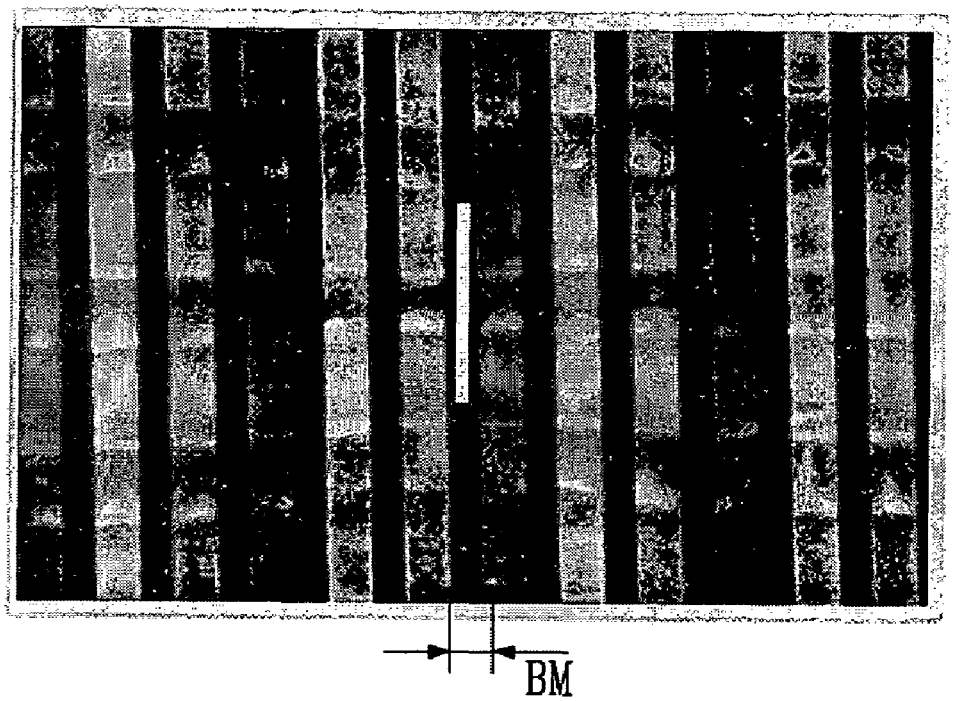
FIGS. 5A and 5B are photographs showing traces of an electron beam depending on the location of end portions of a supporting member relative to a light emission region, according to an exemplary embodiment of the present invention.
Figure 5B:
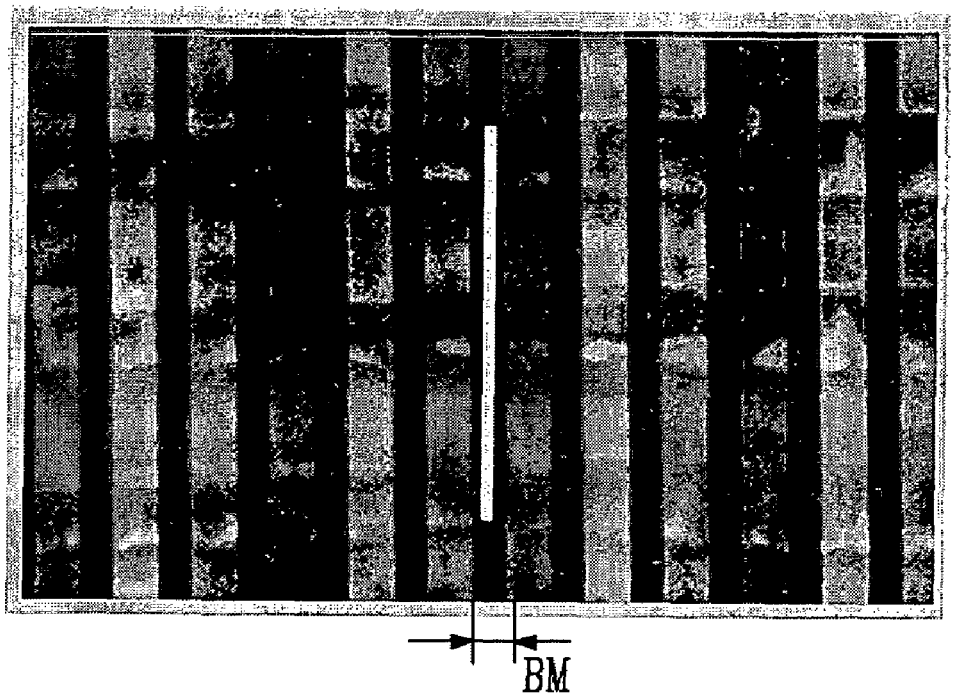

FIGS. 5A and 5B are photographs showing trajectories of the electron beams depending on the location of the end portions of the supporting member relative to a light emission region, according to an exemplary embodiment of the present invention. For reference, "BM" of FIGS. 5A and 5B indicates a black matrix. FIG. 5A illustrates the trajectories of the electron beams when the end portions of the supporting member do not reach the non-light emission region having a predetermined width. FIG. 5B illustrates the trajectories of the electron beams when the end portions of the supporting member reach the non-light emission region having a predetermined width. It can be seen by comparing FIG. 5A with FIG. 5B, that the electron beam is deflected when the end portions of the supporting member are located beyond the non-light emission region, and the electron beam is substantially not deflected when the end portions of the supporting member are respectively located within the non-light emitting region.

Figure 6:
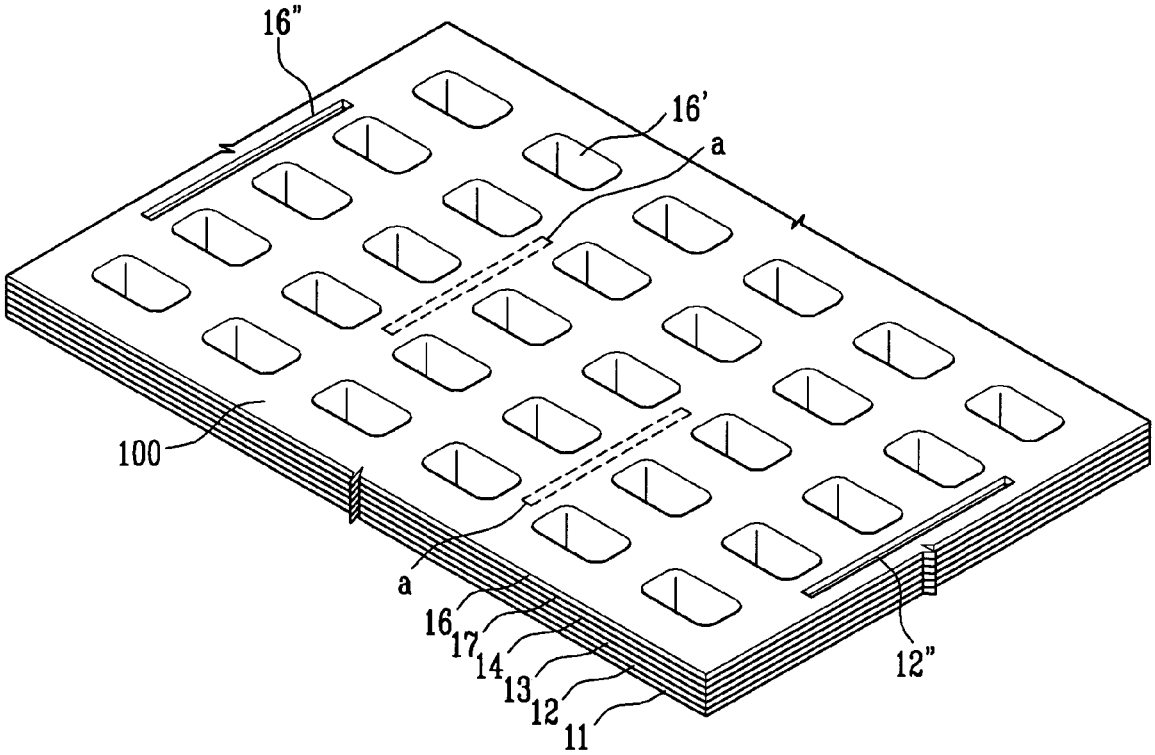
FIGS. 6 and 7 respectively are a partial perspective view and a partial section view that illustrate an electron emission apparatus according to an exemplary embodiment of the present invention.

FIG. 6 is a partial perspective view that illustrates an electron emission apparatus according to an exemplary embodiment of the present invention. In FIG. 6, a supporting member is mounted on a grid electrode by way of example. A grid electrode 16 is formed with a mesh hole 16' and a supporting member insertion hole 16". The mesh hole 16' may be opened toward a fluorescent material of an anode plate (not shown) according to colors, and the supporting member insertion hole 16" is coupled with the end portion of the supporting member. The supporting member that fits in the supporting member insertion hole 16" has end portions that are disposed at intersections between non-light emission regions that are substantially perpendicular to each other.

Referring to FIG. 6, the end of the supporting member insertion hole 16" extends at least to the end of the mesh hole 16'. In this case, the mesh hole 16' is substantially aligned with and corresponds to an upper light emission region (not shown), which is suitable for a structure where the electron beam is emitted perpendicularly to a lower plate. Alternatively, in a structure that the electron beam is deflected in one direction, the mesh hole may not be aligned with the upper light emission region. In this case, the mesh hole and the upper light emission region should be disposed such that the end portion of the supporting member does not interfere with the trajectories of the electron beams.

Referring to FIG. 6, the opposite end portions of the supporting member having a straight shape are disposed at intersections between non-light emission regions 100 (a region excluding the mesh hole) that extend in substantially perpendicular directions with respect to each other, at least one of the non-light emission regions having a predetermined width along an extending direction of the supporting member, so that the electrons emitted from the electron emission part is substantially prevented from causing charges to accumulate on the end portions of the supporting member. Here, the end portions of the supporting member should be disposed in consideration of the light emission regions rather than the mesh hole 16' of the grid electrode.

By way of example, the electron emission apparatus including the grid electrode is configured as follows. The electron emission apparatus includes the anode plate having the fluorescent material as an image display part.

As shown in FIG. 6, a cathode electrode 12, an electron emission part (not shown), a first insulating layer 13, and a gate electrode 14 are formed in sequence on a cathode plate 11. Further, an insulating layer 17 is formed on the grid electrode 16 formed with the mesh hole 16', wherein the grid electrode 16 includes the mesh hole 16' corresponding to each RGB sub-pixel of the fluorescent layer and the supporting member insertion hole 16" to which the end portion of the supporting member is inserted.

The grid electrode 16 is coupled to the gate electrode 14 by a frit or the like. Here, the end portion of the supporting member insertion hole 16" extends at least to the end of the mesh hole 16' such that the end portions of the supporting member are disposed at intersections between non-light emission regions that extend in substantially perpendicular directions with respect to each other. The end portion of the supporting member is inserted in the supporting member insertion hole 16" formed on the grid electrode 16, and then the cathode plate and the anode plate are packaged by a well-know method, wherein the anode plate includes an anode electrode, and the fluorescent layer formed on the anode electrode.

On the other hand, if a supporting member insertion hole "a" does not extend to the end of the mesh hole 16' and extends to a middle of the mesh hole 16' (refer to FIG. 6), the end portions of the supporting member 16 inserted in the supporting member insertion hole "a" are not disposed at intersections between the non-light emission regions that extend in substantially perpendicular directions with respect to each other, and interfere with the electron trajectories, so that the charges charged in the supporting member 16 are increased, thereby deflecting the electron beam and/or generating an arc.

Hereinbelow, the electron emission apparatus according to an exemplary embodiment of the present invention will be described with reference to FIG. 7.

An electron emission device according to an exemplary embodiment of the present invention includes a first plate 120 and a second plate 110 spaced from each other by a supporting member 134 at a predetermined distance. A frit 132 is applied and annealed to define the space between the first plate 120 and the second plate 110, and the space between the first plate 120 and the second plate 110 is exhausted and kept in vacuum.

The first plate 120 includes an electron emission part sectioned according to sub-pixels and emitting electrons. Each sub-pixel is defined by a cathode electrode 122 and a gate electrode 126 crossing the cathode electrode 122, wherein the cathode electrode 122 and the gate electrode 126 are insulated by an insulating layer 124 having a predetermined thickness. Further, the gate electrode 126 is formed with a gate hole having a predetermined size through which the electrons emitted from the electron emission part 123 pass. The electron emission part 123 is formed on the cathode electrode 122 exposed through the gate hole and emits electrons.

Figure 7:
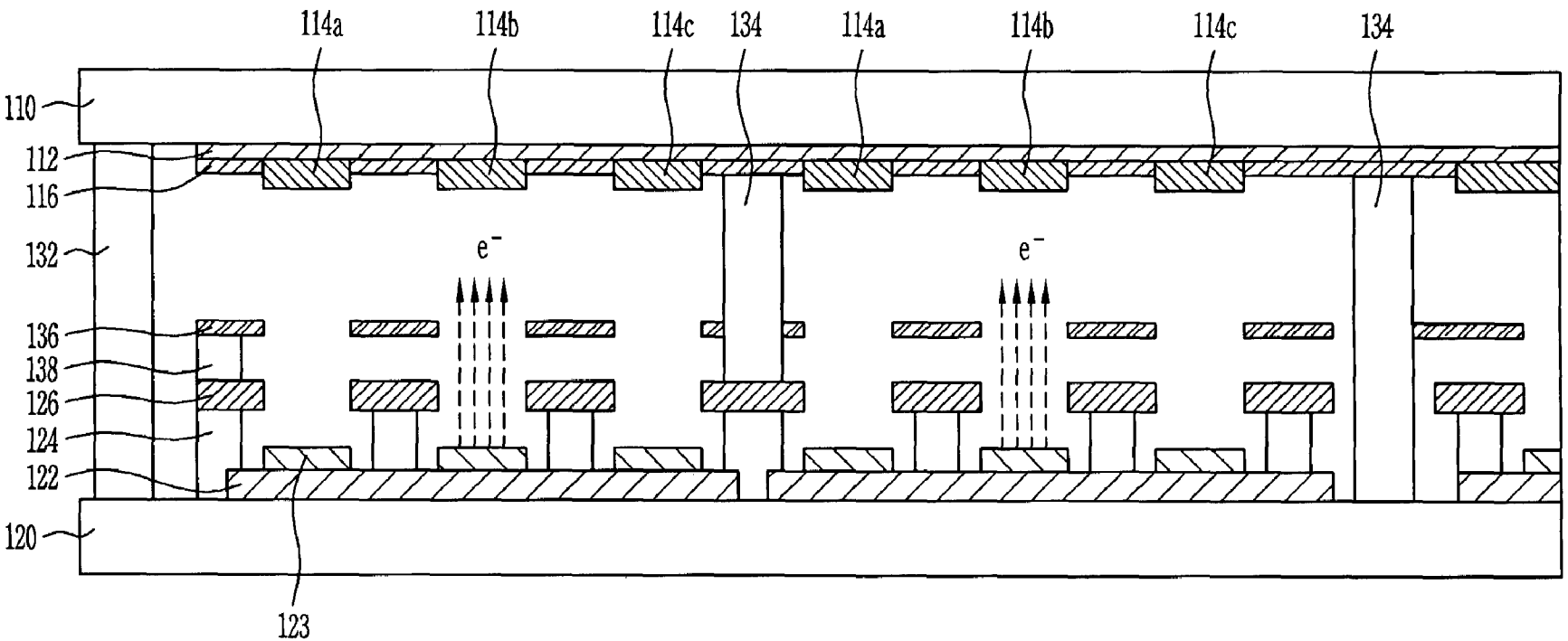

Referring to FIG. 7, the second plate 110 includes a light emission regions 114*a*, 114*b*, 114*c* and non-light emission regions 116, wherein the light emission regions 114*a*, 114*b*, 114*c* are defined by a region corresponding to the electron emission part and in which the electrons collide with the fluorescent material. Further, the second plate 110 includes at least one anode electrode 112, and the RGB fluorescent materials arranged on at least a portion of the anode electrode 112 function as the light emission regions 114*a*, 114*b*, 114*c*. Additionally, an optical shielding film 116 may be interposed between the light emission regions. The fluorescent material 114*a*, 114*b*, 114*c* and the optical shielding film 116 may be formed by an electro-phoresing method, a screen printing, a slurry method, etc. Here, the anode electrode 112 is made of a transparent electrode such as indium tin oxide (ITO) or the like, or made of a thin metal layer. Also, the anode electrode 112 includes a single type electrode, a stripe type electrode, or a partition type electrode. Further, the fluorescent material 114*a*, 114*b*, 114*c* can have a stripe shape, or a doffed shape.

As necessary, a grid electrode 136 made of conductive metallic material is provided in the space between the first plate 120 and the second plate 110 so as to enhance an electron focusing effect and prevent arc discharge. In FIG. 7, a reference numeral of 138 indicates a grid holder made of an insulating material and supporting the conductive mesh 136.

With this configuration, the opposite end portions of the supporting member are disposed at intersections between the non-light emission regions 100 that extend in substantially perpendicular directions with respect to each other, at least one of the non-light emission regions having a predetermined width along an extending direction of the supporting member, thereby substantially preventing the electrons emitted from the electron emission part from causing charges to accumulate on the end portions of the supporting member 134.

In the described embodiments, the electron emission part is made of a material capable of emitting electrons when an electric field is applied thereto and is controlled by the electrons, but not limited to, and may vary as long as it can be used as an electron emission device.

As described above, the present invention provides an electron emission apparatus, in which end portions of a supporting member are disposed in consideration of relative positions with respect to light emission regions, that is, the end portions of the supporting member are disposed at intersections between non-light emission regions that extend in substantially perpendicular directions with respect to each other, so that an electron beam is substantially prevented from deflecting and an arc is substantially prevented from arising. In other words, the exemplary embodiment of the present invention substantially prevents the electric charges being charged on the supporting member by a predetermined quantity of electric charge or more and bolting out of the supporting member.

Although certain exemplary embodiments of the present invention have been shown and described, it would be appreciated by those skilled in the art that changes may be made in the described embodiments without departing from the spirit or the scope of the invention, the scope of which is defined in the claims and their equivalents.

What is claimed is:

1. An electron emission apparatus comprising:

a first plate sectioned according to sub-pixels and including an electron emission part;

a second plate opposite to the first plate and comprising a plurality of light emission regions in which electrons emitted by the electron emission part collide with a fluorescent material and a plurality of non-light emission regions; and a supporting member extending in at least one direction and supporting the first and second plates, wherein end portions of the supporting member are disposed at intersections between the non-light emission regions that extend in substantially perpendicular directions with respect to each other, at least one of the non-light emission regions having a predetermined width along the at least one extending direction of the supporting member.

2. The electron emission apparatus according to claim 1, wherein at least one portion of the non-light emission regions is provided with an optical shielding film.

3. The electron emission apparatus according to claim 1, wherein the supporting member has either a cross shape or a straight shape.

4. The electron emission apparatus according to claim 1, wherein the fluorescent material is provided in each of the light emission regions.

5. The electron emission apparatus according to claim 1, wherein the fluorescent material has either a stripe shape or a matrix shape.

6. The electron emission apparatus according to claim 1, wherein the supporting member has a length of L in the case where each of the light emission regions has a rectangular shape having a width of $X_1$ and a length of $Y_1$ and each intersection between the non-light emission regions has a width of $X_2$ and a length of $Y_2$, wherein the length L of the supporting member is defined by the following equations:

$n(X_1+X_2)-X_2 \leqq L \leqq n(X_1+X_2)+X_2$, (where, n is a natural number); and $m(Y_1+Y_2)-Y_2 \leqq L \leqq m(Y_1+Y_2)+Y_2$, (where, m is a natural number).

7. An electron emission apparatus comprising:

a first plate sectioned according to sub-pixels and including an electron emission part;

a second plate opposite to the first plate and comprising a plurality of light emission regions in which electrons emitted according to the sub-pixels formed in a matrix shape collide and a plurality of non-light emission regions formed between the sub-pixels; and a supporting member extending in at least one direction and supporting the first and second plates, wherein end portions of the supporting member are disposed at intersections between the non-light emission regions that extend in substantially perpendicular directions with respect to each other, at least one of the non-light emission regions having a predetermined width along the at least one extending direction of the supporting member.

8. The electron emission apparatus according to claim 7, wherein the supporting member has either a cross shape or a straight shape.

9. The electron emission apparatus according to claim 7, wherein at least one portion of the non-light emission regions is provided with an optical shielding film.

10. The electron emission apparatus according to claim 7, further comprising a fluorescent material includes stripe-shaped fluorescent materials, and the electrons collide with the stripe-shaped fluorescent materials to emit light.

11. The electron emission apparatus according to claim 10, further comprising an optical shielding film disposed between the stripe-shaped fluorescent materials.

12. The electron emission apparatus according to claim 10, wherein the supporting member has either a cross shape or a straight shape.

13. An electron emission apparatus comprising:

a first plate including a plurality of electron emission parts that correspond to sub-pixels;

a second plate comprising a plurality of light emission regions and a plurality of non-light emission regions, wherein the light emission regions correspond to the sub-pixels; and a supporting member extending in at least one direction and supporting the first and second plates, wherein end portions of the supporting member are located at intersections between the non-light emission regions that extend in substantially perpendicular directions with respect to each other.

14. The electron emission apparatus according to claim 13, wherein the supporting member has either a cross shape or a straight shape.

15. The electron emission apparatus according to claim 13, wherein a fluorescent material is provided in each of the light emission regions.

16. The electron emission apparatus according to claim 15, wherein the fluorescent material has either a stripe shape or a matrix shape.

17. An electron emission apparatus comprising:

a first plate including a plurality of electron emission parts that correspond to sub-pixels;

a second plate comprising a plurality of light emission regions and a plurality of non-light emission regions, wherein the light emission regions correspond to the sub-pixels and have a plurality of sides; and a supporting member extending in at least one direction and supporting the first and second plates, wherein end portions of the supporting member are located at non-light emission regions that are not adjacent to the sides of the light emission regions.

* * * * *